US010234237B1

(12) United States Patent
Jager

(10) Patent No.: US 10,234,237 B1
(45) Date of Patent: Mar. 19, 2019

(54) INTEGRATED FIXED SIGHT ON FIREARM MUZZLE DEVICE

(71) Applicant: John Jager, Kalamazoo, MI (US)

(72) Inventor: John Jager, Kalamazoo, MI (US)

( * ) Notice: Subject to any disclaimer, the term of this patent is extended or adjusted under 35 U.S.C. 154(b) by 0 days.

(21) Appl. No.: 15/960,161

(22) Filed: Apr. 23, 2018

Related U.S. Application Data

(63) Continuation-in-part of application No. 15/820,116, filed on Nov. 21, 2017.

(51) Int. Cl.
*F41A 21/00* (2006.01)
*F41G 1/02* (2006.01)
*F41A 21/36* (2006.01)

(52) U.S. Cl.
CPC ..... *F41G 1/02* (2013.01); *F41A 21/36* (2013.01)

(58) Field of Classification Search
CPC ..... F41A 21/30; F41A 21/32; F41A 21/325; F41A 21/34; F41A 21/36; F41A 21/38; F41G 1/02
See application file for complete search history.

(56) References Cited

U.S. PATENT DOCUMENTS 1,174,063 A * 3/1916 Frank ..... F41G 1/02 42/144
2,322,370 A * 6/1943 Lance ..... F41A 21/36 89/14.3
4,479,418 A * 10/1984 Beretta ..... F41A 21/30 89/14.4
4,709,497 A * 12/1987 Resca ..... F41A 21/32 42/7
5,076,137 A * 12/1991 Paredes ..... F41A 21/36 89/14.3
5,155,291 A * 10/1992 Dabrowski ..... F41A 21/16 42/78
2003/0154849 A1* 8/2003 Breuer ..... F41A 21/36 89/14.3
2010/0024274 A1* 2/2010 Lippard ..... F41A 17/56 42/70.05
2018/0058792 A1* 3/2018 Schirmer ..... F41A 21/28

FOREIGN PATENT DOCUMENTS

DE 3831766 A1 * 3/1990 ..... F41A 21/36

* cited by examiner

*Primary Examiner* — Gabriel J. Klein

(57) ABSTRACT

An integrated fixed sight on a firearm consists of a front sighting device and an external muzzle device. The external muzzle device includes a proximal end, a central axis, a mount body, a top surface, and a distal end. The front sighting device is laterally aligned with the central axis and mounted onto the top surface adjacent the proximal end. The front sighting device can vary in size and shape. The external muzzle device is mounted onto the barrel of the firearm through a clamp and a fastening mechanism. Since the threads on the barrel are not used, the threads of the barrel are preserved.

9 Claims, 6 Drawing Sheets

INTEGRATED FIXED SIGHT ON FIREARM MUZZLE DEVICE

The current application is a continuation-in-part (CIP) application of the U.S. non-provisional application Ser. No. 15/820,116 filed on Nov. 21, 2017.

FIELD OF THE INVENTION

The present invention relates generally to muzzle devices. In particular, the present invention introduces an alignment marker that is mounted onto an external muzzle device. By utilizing the present invention, the alignment purposes of a firearm can be fulfilled even when an external muzzle device is used.

BACKGROUND OF THE INVENTION

A muzzle device is generally used on the muzzle of a firearm or cannon. Muzzle devices are used to redirect propellant gasses to counter recoil and unwanted rising of the barrel during rapid fire. Even though there are significant advantages of using a muzzle device, there are some notable disadvantages too.

In general, the muzzle device is positioned perimetrically around the barrel of the firearm. Thus, the muzzle device can obstruct the view along the existing front sight of the firearm when the firearm is in use. As a result, the existing front sight of the firearm cannot be utilized in some instances.

A considerable number of existing muzzle devices do not have a front sight. Thus, a user who routinely uses a front sight when firing can have difficulties using the firearm when a muzzle device is attached. To cater a wide range of users, it is clear that the external muzzle devices need to be appropriately designed.

The objective of the present invention is to address the aforementioned issues. To do so, the present invention introduces a front sight that is mounted onto an external muzzle device. Thus, the user can utilize the front sight for alignment purposes even when the external muzzle device is used. More specifically, the present invention provides an alignment aid even if the muzzle device obstructs the view along the original front sight of the firearm.

DETAIL DESCRIPTIONS OF THE INVENTION

All illustrations of the drawings are for the purpose of describing selected versions of the present invention and are not intended to limit the scope of the present invention.

The present invention introduces a front sighting device that is used for aiming purposes when a firearm is used.

More specifically, the present invention describes a front sighting device that is used along with an external muzzle device that is mounted to the barrel of a firearm. By utilizing the present invention, the user can use the muzzle device for redirecting propellant gasses and simultaneously use the front sighting device for aiming purposes.

As shown in FIGS. 1-6, to fulfill the intended functionalities, the present invention comprises a front sighting device 1 and an external muzzle device 12. The front sighting device 1, which is used in aiming of a firearm, can vary in size and shape in different embodiments of the present invention. The external muzzle device 12, which prevents unwanted rise of the firearm barrel 100, can also vary in size and shape in different embodiments of the present invention. In general, the front sighting device 1 is mounted onto the external muzzle device 12.

Figure 1:
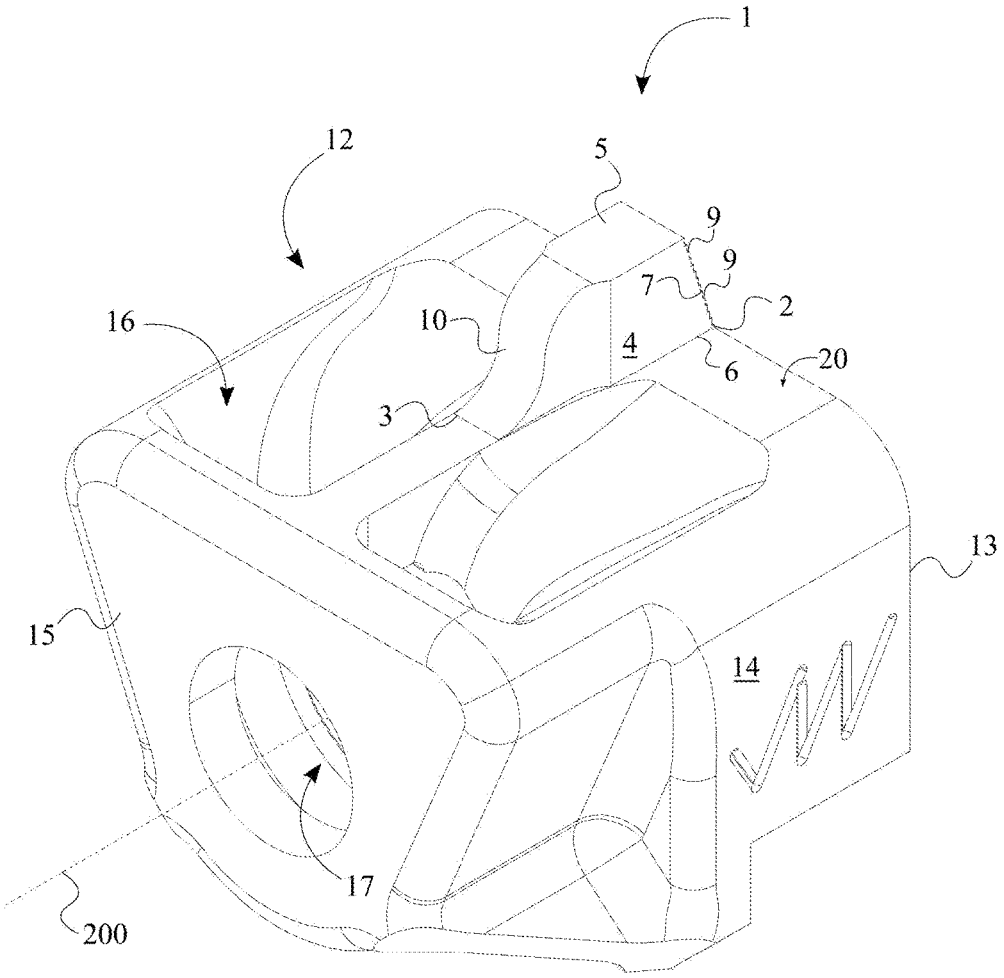
FIG. 1 is a perspective view of the present invention being mounted onto the external muzzle device.
Figure 2:
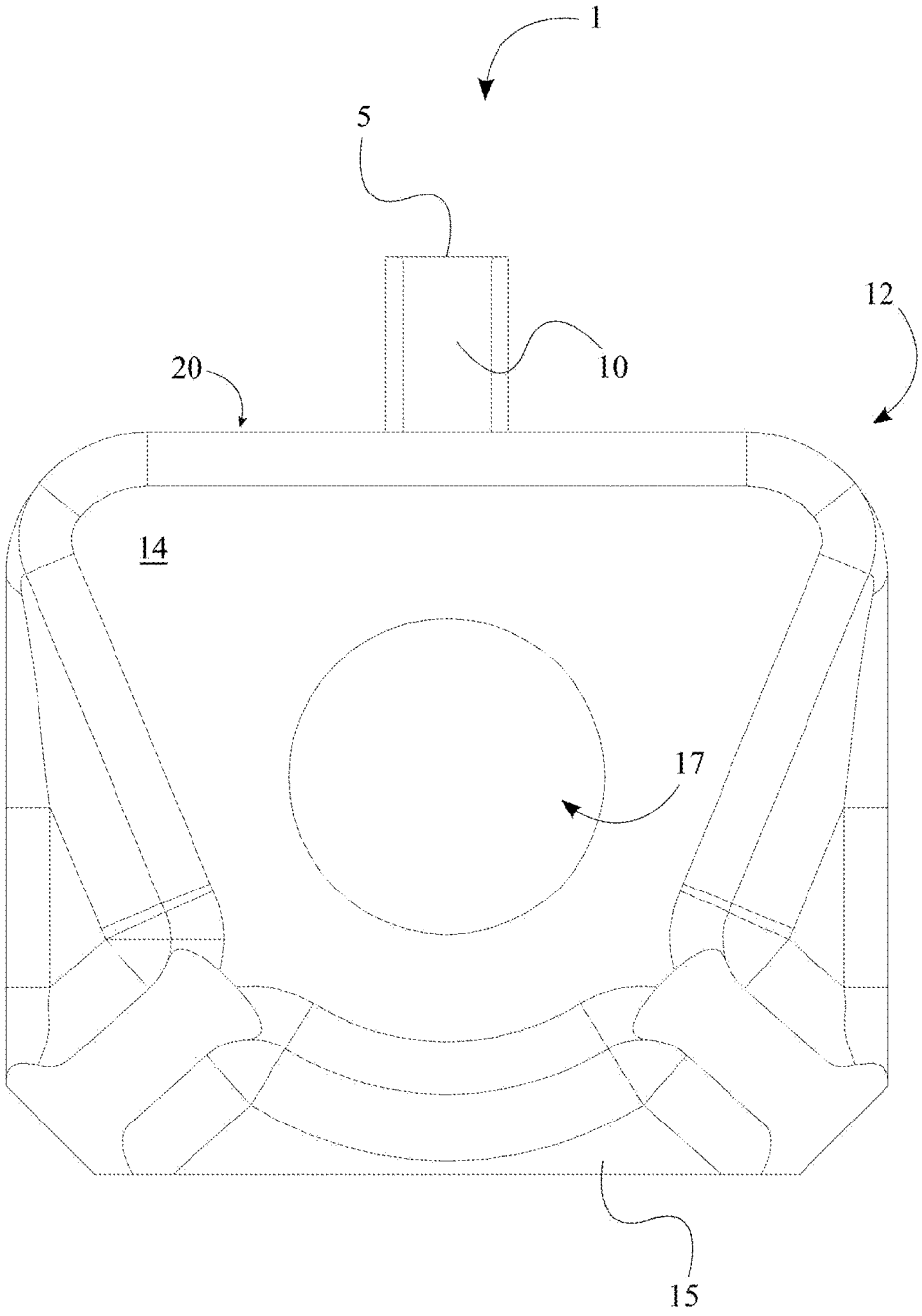
FIG. 2 is a front view of the present invention being mounted onto the external muzzle device.
Figure 3:
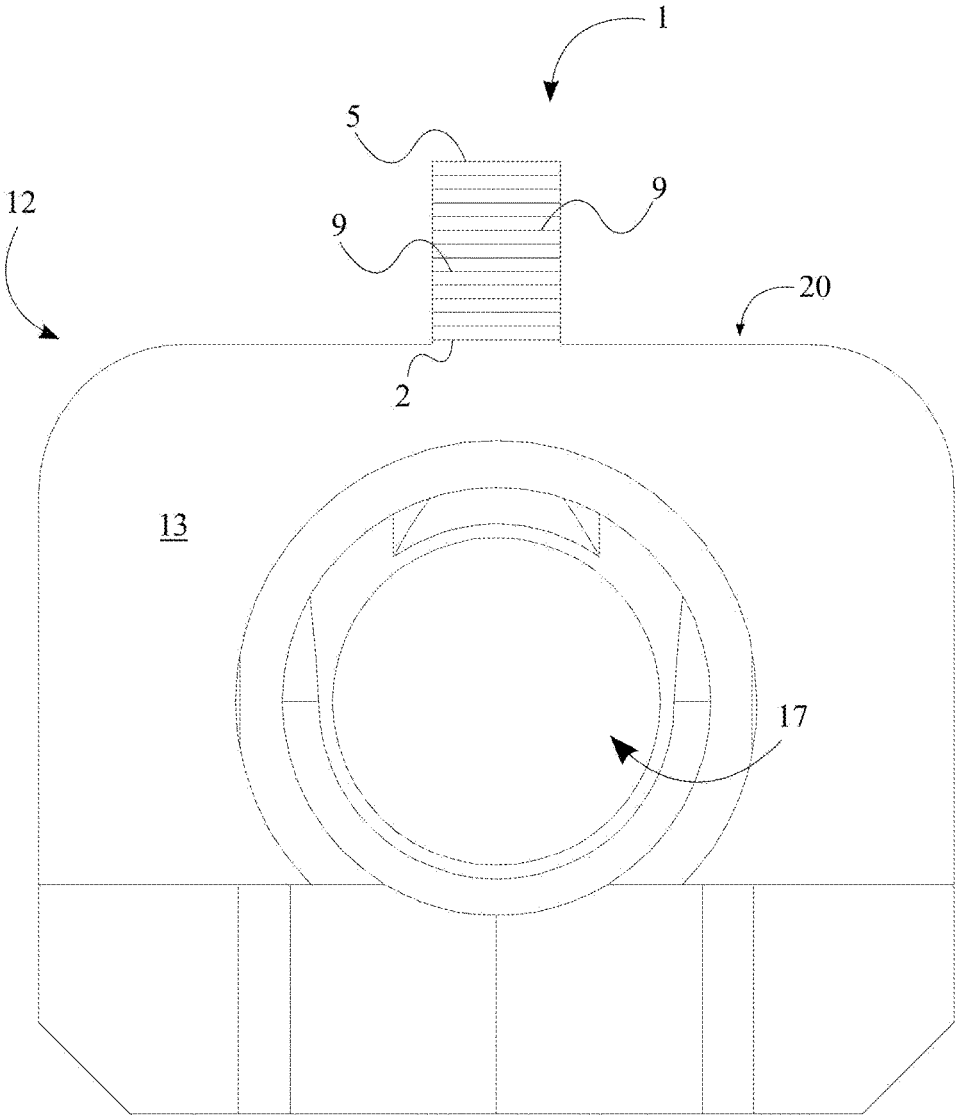
FIG. 3 is a rear view of the present invention being mounted onto the external muzzle device.
Figure 4:
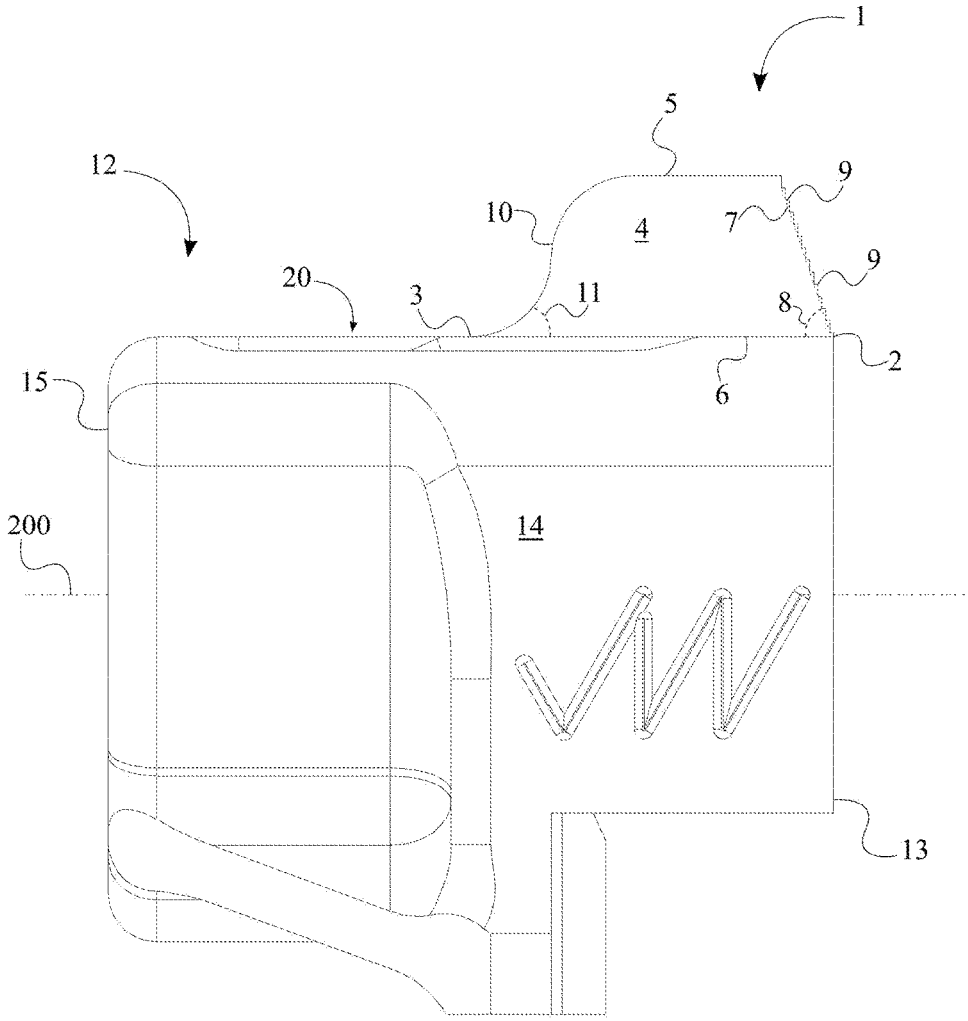
FIG. 4 is a side view of the present invention being mounted onto the external muzzle device.

As seen in FIG. 4, the front sighting device 1 comprises a first end 2, a second end 3, a structural body 4, a top edge 5, and a bottom edge 6. The structural body 4, which forms the overall shape of the front sighting device 1, extends from the first end 2 to the second end 3 and determines an overall length of the front sighting device 1. As discussed before, the overall length of the front sighting device 1 can vary in different embodiments of the present invention. A distance between the bottom edge 6 and the top edge 5 determines an overall height of the front sighting device 1. Thus, the structural body 4 is positioned in between the top edge 5 and the bottom edge 6. Similar to the overall length of the structural body 4, the height of the structural body 4 can also vary in different embodiments of the present invention. In particular, according to user preference and according to the firearm the present invention is used with, the front sighting device 1 can be a short front sighting device or a tall front sighting device.

Figure 5:
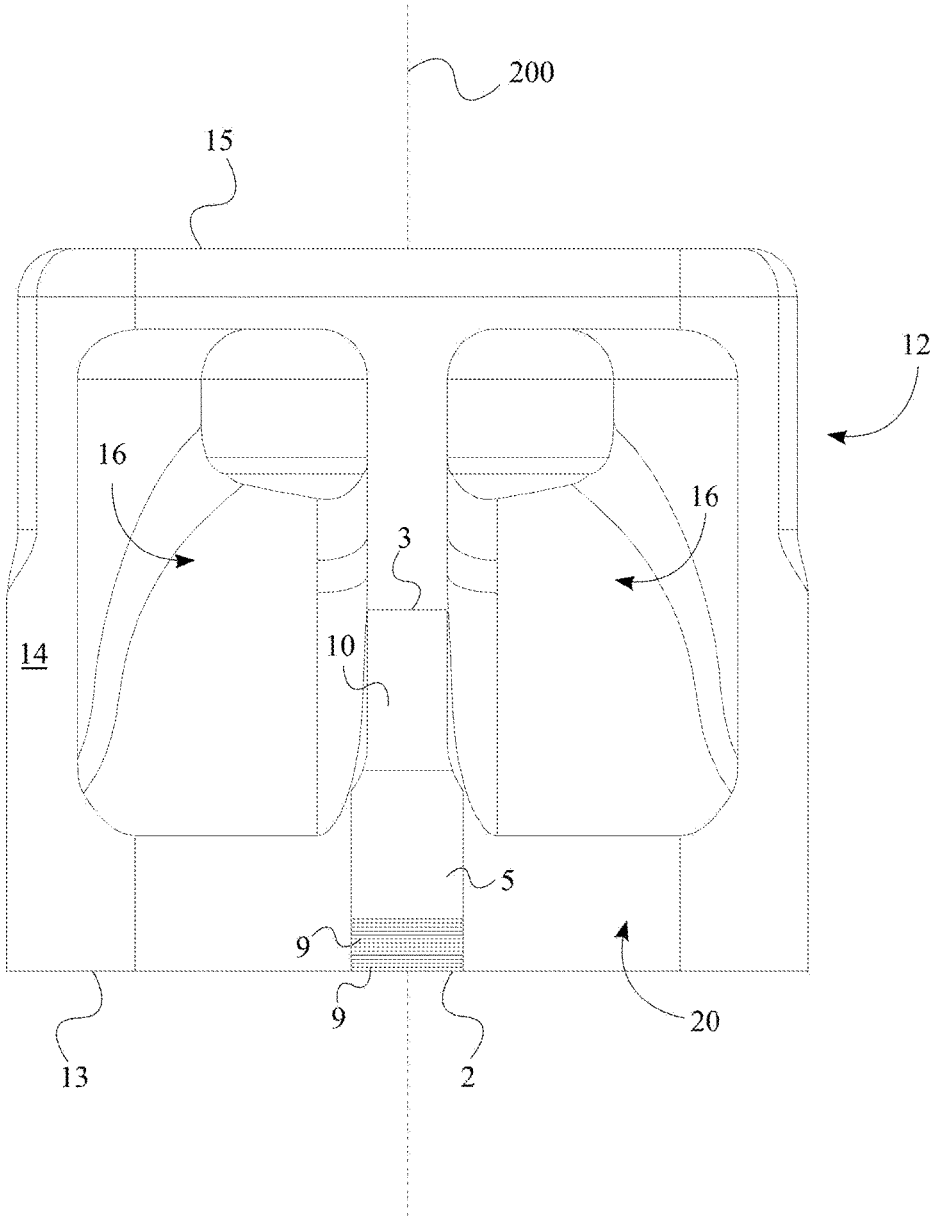
FIG. 5 is a top view of the present invention being mounted onto the external muzzle device.

As illustrated in FIG. 4 and FIG. 5, the external muzzle device 12, which can vary in size and shape in different embodiments, comprises a proximal end 13, a central axis 200, a mount body 14, a top surface 20, and a distal end 15. The mount body 14, which is terminally mounted to the barrel 100 of a firearm, extends from the proximal end 13 to the distal end 15 and determines the overall length of the external muzzle device 12. The central axis 200, extends along the mount body 14 perpendicular to the proximal end 13 and the distal end 15 and determines the path for a barrel-receiving channel 17. The top surface 20, which is planar, is used as a mounting surface for the front sighting device 1. More specifically, when the front sighting device 1 is connected to the external muzzle device 12, the bottom edge 6 is connected to the external muzzle device 12 at the top surface 20. Furthermore, the front sighting device 1 is laterally aligned with the central axis 200, and the first end 2 is positioned adjacent the proximal end 13. Thus, the overall functionality of the external muzzle device 12 is not affected by the presence of the front sighting device 1.

As mentioned before the front sighting device 1 can vary in shape and size in different embodiments. As seen in FIG. 4, in addition to the top edge 5 and the bottom edge 6, the front sighting device 1 further comprises a rear surface 7 and a front surface 10 that help determine the overall shape of the front sighting device 1. The rear surface 7 extends from the bottom edge 6 to the top edge 5 at the first end 2. On the other hand, the front surface 10 extends from bottom edge 6 to the top edge 5 at the second end 3. The positioning of the rear surface 7 and the front surface 10 can vary in different embodiments. As seen in FIG. 4, in the preferred embodiment, the rear surface 7 is positioned at a first acute angle 8 to the bottom edge 6. In the preferred embodiment, the present invention further comprises a plurality of notches 9 that is distributed along the rear surface 7 from the bottom edge 6 to the top edge 5. On the other hand, the front surface 10 is positioned at a second acute angle 11 to the bottom edge 6. Moreover, in the preferred embodiment, the front surface 10 is tapered from the top edge 5 to the bottom edge 6.

The external muzzle device 12 can vary in different embodiments of the present invention. In the preferred embodiment, the external muzzle device 12 further comprises at least one gas discharge vent 16 that traverses into the mount body 14 at the top surface 20. When traversed, the at least one gas discharge vent 16 is positioned adjacent the distal end 15. The number of vents of the at least one gas discharge vent 16 can vary in different embodiments.

As detailed before, the mount body 14 is terminally mounted onto the barrel 100 of the firearm. To do so, the external muzzle device 12 further comprises a barrel-receiving channel 17 that traverses through the mount body 14 from the proximal end 13 to the distal end 15. Moreover, the barrel-receiving channel 17 is positioned along the central axis 200. The diameter of the barrel-receiving channel 17 is selected such that the barrel 100 of the firearm is tightly positioned within the barrel-receiving channel 17.

Figure 6:
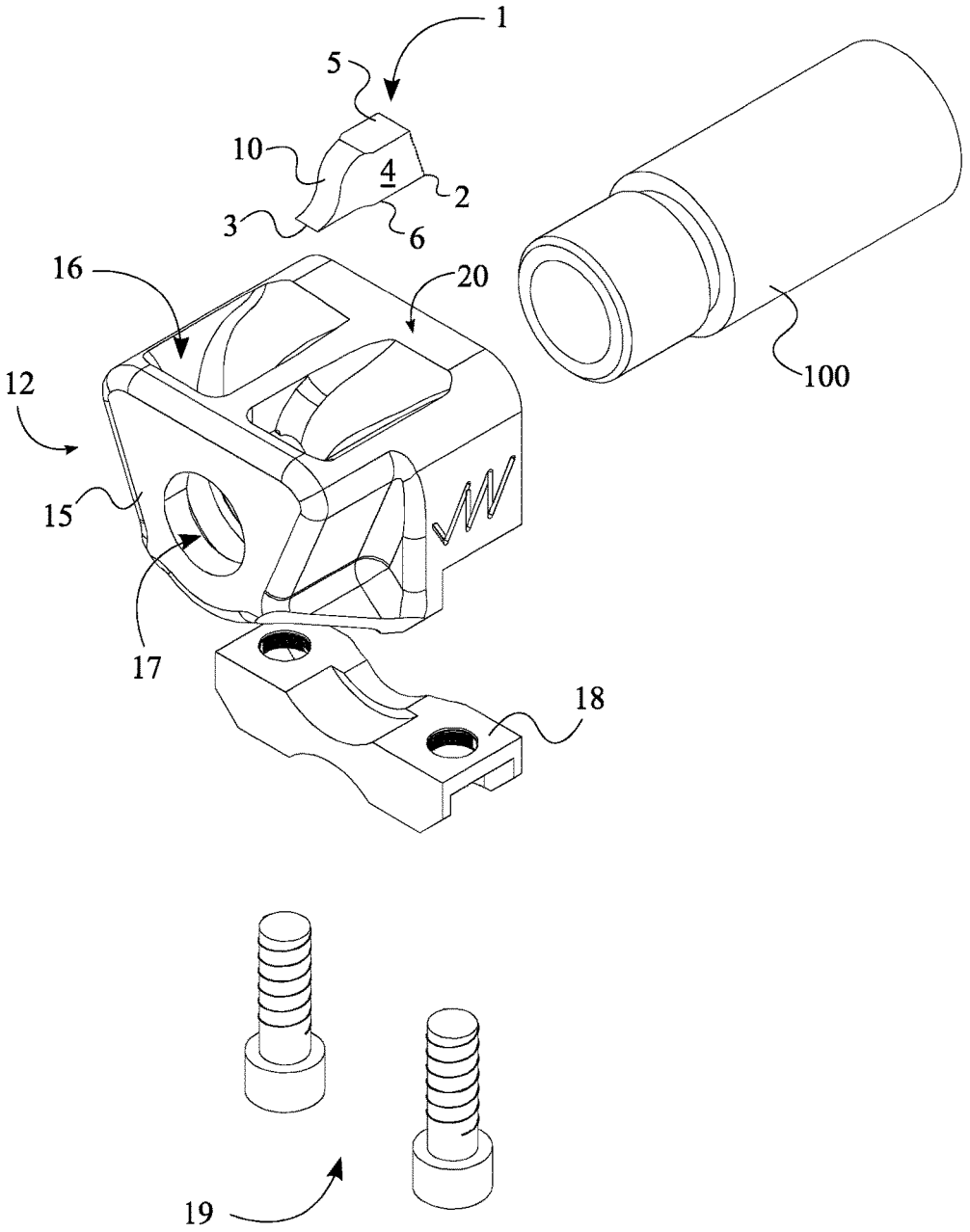
FIG. 6 is a perspective exploded view of the present invention illustrating the external muzzle device, the clamp, and the fastening mechanism.

In general, the threads on the barrel 100 are utilized for mounting an external muzzle device 12 to a firearm. Repeated use of the threads can damage the threads over time. As shown in FIG. 6, to prevent such damages, the present invention further comprises a clamp 18 and a fastening mechanism 19. When the clamp 18 and the fastening mechanism 19 are used, the barrel 100 of the firearm is secured in between the mount body 14 and the clamp 18. In other words, the clamp 18 is removably attached to the mount body 14 with the fastening mechanism 19 adjacent the proximal end 13. When attached, the clamp 18 is positioned opposite the front sighting device 1 and across the mount body 14. Thus, the front sighting device 1 can be conveniently aligned with the rear sighting device which is vital for accuracy.

When the preferred embodiment of the present invention is in use, the following process flow is generally followed. Initially, the external muzzle device 12 is selected with a front sighting device 1 of a preferred height. When selected, the barrel 100 of the firearm is inserted into the barrel-receiving channel 17 at the proximal end 13. Next, the front sighting device 1 is aligned as needed and the clamp 18 is attached to the mount body 14 with the fastening mechanism 19.

Although the invention has been explained in relation to its preferred embodiment, it is to be understood that many other possible modifications and variations can be made without departing from the spirit and scope of the invention as hereinafter claimed.

What is claimed is:

1. A sight system comprising:
a front sighting device;
an external muzzle device;
the front sighting device being connected to the external muzzle device;
the front sighting device comprising a first end, a second end, a structural body, a top edge, a bottom edge, a rear surface and a front surface;
the external muzzle device comprising a proximal end, a central axis, a mount body, a top surface, a bottom surface and a distal end;
the structural body extending from the first end to the second end and being positioned in between the top edge and the bottom edge;
the mount body extending from the proximal end to the distal end and being positioned in between the top surface and the bottom surface;
the central axis extending along the mount body perpendicular to the proximal end and the distal end;
the bottom edge being connected to the top surface;
the front sighting device being laterally aligned with the central axis;
the first end being positioned adjacent the proximal end;
the rear surface extending from the bottom edge to the top edge at the first end;
the front surface extending from the bottom edge to the top edge at the second end;
the rear surface being positioned at a first acute angle to the bottom edge;
the front surface being positioned at a second acute angle to the bottom edge;
the front surface being tapered from the top edge to the bottom edge; and
the front surface being an S-shaped curved surface.

2. The sight system as claimed in claim 1 comprising:
a plurality of notches; and
the plurality notches being distributed along the rear surface from the bottom edge to the top edge.

3. The sight system as claimed in claim 1 comprising:
the external muzzle device comprising at least one gas discharge vent;
the at least one gas discharge vent traversing into the mount body at the top surface; and
the at least one gas discharge vent being positioned adjacent the distal end.

4. The sight system as claimed in claim 1 comprising:
the external muzzle device comprising a barrel-receiving channel;
the barrel-receiving channel traversing through the mount body from the proximal end to the distal end; and
the barrel-receiving channel being positioned along the center axis.

5. The sight system as claimed in claim 1 comprising:
a clamp;
a fastening mechanism;
the clamp being removably attached to the mount body with the fastening mechanism adjacent the proximal end; and
the clamp being positioned opposite the front sighting device and across the mount body.

6. A sight system comprising:
a front sighting device;
an external muzzle device;
the front sighting device being connected to the external muzzle device;
the front sighting device comprising a first end, a second end, a structural body, a top edge, a bottom edge, a rear surface and a front surface;
the external muzzle device comprising two gas discharge vents, a proximal end, a central axis, a mount body, a top surface, a bottom surface and a distal end;
the structural body extending from the first end to the second end and being positioned in between the top edge and the bottom edge;
the mount body extending from the proximal end to the distal end and being positioned in between the top surface and the bottom surface;

the central axis extending along the mount body perpendicular to the proximal end and the distal end;

the bottom edge being connected to the top surface;

the front sighting device being laterally aligned with the central axis;

the first end being positioned adjacent the proximal end;

the rear surface extending from the bottom edge to the top edge at the first end;

the front surface extending from the bottom edge to the top edge at the second end;

the rear surface being positioned at a first acute angle to the bottom edge;

the front surface being positioned at a second acute angle to the bottom edge;

the front surface being tapered from the top edge to the bottom edge;

the front surface being an S-shaped curved surface;

the two gas discharge vents each traversing into the mount body at the top surface;

the two gas discharge vents being separate from each other; and the front sighting device being located in between the two gas discharge vents.

7. The sight system as claimed in claim 6 comprising:

a plurality of notches; and the plurality notches being distributed along the rear surface from the bottom edge to the top edge.

8. The sight system as claimed in claim 6 comprising:

the external muzzle device comprising a barrel-receiving channel;

the barrel-receiving channel traversing through the mount body from the proximal end to the distal end; and the barrel-receiving channel being positioned along the center axis.

9. The sight system as claimed in claim 6 comprising:

a clamp;

a fastening mechanism;

the clamp being removably attached to the mount body with the fastening mechanism adjacent the proximal end; and the clamp being positioned opposite the front sighting device and across the mount body.

* * * * *